US006106639A

United States Patent [19]

Marandel et al.

[11] Patent Number: 6,106,639

[45] Date of Patent: Aug. 22, 2000

[54] STAINLESS STEEL WIRE AND PROCESS OF MANUFACTURE

[75] Inventors: Joël Marandel, Varennes-Vauzelles; Jean-Michel Hauser, Ugine, both of France

[73] Assignees: Sprint Metal Société de Production Internationale de Tréfilés; Imphy S.A., both of Puteaux; Ugine Savoie, Ugine, all of France

[21] Appl. No.: 08/993,658

[22] Filed: Dec. 18, 1997

[30] Foreign Application Priority Data

Dec. 31, 1996 [FR] France ..... 96 16250

[51] Int. Cl.[7] ..... C21D 8/06; C22C 38/20

[52] U.S. Cl. ..... 148/327; 148/580; 148/597; 148/608; 148/908; 428/606

[58] Field of Search ..... 148/580, 597, 148/608, 908, 326, 327; 428/606

[56] References Cited

U.S. PATENT DOCUMENTS

| | | |
|---|---|---|
| 3,282,684 | 11/1966 | Allen . |
| 4,022,586 | 5/1977 | Espy . |
| 4,222,773 | 9/1980 | Degerbeck . |

FOREIGN PATENT DOCUMENTS

| | | | |
|---|---|---|---|
| 0 567 365 A1 | 10/1993 | European Pat. Off. . | |
| 0 646 653 A1 | 4/1995 | European Pat. Off. . | |
| 2 478 675 | 9/1981 | France . | |
| 2 338 282 | 2/1974 | Germany . | |
| 28366 | 2/1980 | Japan | 420/49 |
| 77364 | 6/1981 | Japan | 420/49 |

OTHER PUBLICATIONS

Nishimura, Tsukasa, JP409049019A, English abstract, Feb. 18, 1997.

JP 07316743A, JP07316743A, English Abstract, Dec. 5, 1995.

*Primary Examiner*—Deborah Yee
*Attorney, Agent, or Firm*—Oblon, Spivak, McClelland, Maier & Neustadt, P.C.

[57] ABSTRACT

Stainless steel wire of diameter smaller than 2 mm and with a tensile strength greater than 2100 MPa, consisting of a steel whose chemical composition includes, by weight: $0\% \leqq C \leqq 0.03\%$, $0\% \leqq Mn \leqq 2\%$, $0\% \leqq Si \leqq 0.5\%$, $8\% \leqq Ni \leqq 9\%$, $17\% \leqq Cr \leqq 18\%$, $0\% \leqq Mo \leqq 0.4\%$, $3\% \leqq Cu \leqq 3.5\%$, $0\% \leqq N \leqq 0.03\%$, $S \leqq 0.01\%$, $P \leqq 0.04\%$, the remainder being iron and impurities resulting from the production. Process of manufacture of the wire and uses.

12 Claims, No Drawings

STAINLESS STEEL WIRE AND PROCESS OF MANUFACTURE

FIELD OF THE INVENTION

The present invention relates to a stainless steel wire of small diameter which has high mechanical characteristics and can be employed especially for the manufacture of springs or wires for the reinforcement of elastomers.

PRIOR ART

Fine drawn wires are known which have very high mechanical characteristics and consist of an unstable austenitic stainless steel of the 1.4310 type (according to standards EN 10088 and Pr EN 10270.3), the chemical analysis of which includes, by weight, from 16 to 19% of chromium, from 6 to 9.5% of nickel, not more than 0.8% of molybdenum, not more than 0.11% of nitrogen and from 0.05 to 0.15% of carbon. The mechanical characteristics obtained for the drawn wire result both from the cold working and from the formation of α' martensite generated by the cold working resulting from the wiredrawing. These wires can be employed for the manufacture of springs which are obtained by forming the wire and then relaxing and hardening heat treatment. This technique has at least one disadvantage which results from the very great consolidation during the drawing. As a result of the extent of this consolidation, when the wire diameter is small, only a few alternating drawing and hyperquenching heat treatment cycles can be obtained. This complicates the manufacture and increases its cost.

There are also known fine drawn wires which have very high mechanical characteristics and can be employed especially for the manufacture of springs, consisting of an austenitic stainless steel with secondary hardening by precipitation of NiAl, of the 1.4568 type (according to standard EN 10088 and Pr EN 10270), whose chemical analysis includes, by weight, from 16 to 18% of chromium, from 6.5 to 7.8% of nickel and from 0.7 to 1.5% of aluminum.

This technique has the advantage of enabling springs to be manufactured from a wire of mechanical characteristics which are substantially lower than the mechanical characteristics desired for the spring, and this makes it easier to carry out the forming operation. The final mechanical characteristics can, in fact, be obtained by an aging heat treatment which produces a hardening by precipitation. On the other hand, this technique, firstly, has the disadvantage of employing steel grades containing elements which are easily oxidizable or nitridable, which give rise to the formation of inclusions that are detrimental to the fatigue strength of the springs, and, secondly, these steel grades result, as in the preceding case, in a very considerable consolidation during the wiredrawing and this, in the same way, requires a succession of alternating wiredrawing and hyperquenching treatment cycles.

SUMMARY OF THE INVENTION

The aim of the present invention is to overcome these disadvantages by providing an austenitic stainless steel wire which can be hardened by precipitation, which has, in the cold-worked state before aging, a tensile strength higher than 2200 MPa at a diameter of between 0.4 and 0.5 mm, higher than 2225 MPa at a diameter of between 0.3 and 0.4 mm, higher than 2250 MPa at a diameter of between 0.2 and 0.3 mm, higher than 2275 mm at a diameter smaller than 0.2 mm, and which is easy to draw or to roll cold.

This wire may be round, oval or polygonal in section, for example triangular, square, rectangular or hexagonal in section. When it is round in section its size is defined by its diameter; when it is not round in section its size is defined by the diameter of a wire whose section would have the same area. In all cases the diameter of the wire will be referred to.

To this end, the subject matter of the invention is a stainless steel wire of diameter smaller than 2 mm and with a tensile strength higher than 2100 MPa, consisting of a steel whose chemical composition includes, by weight:

| | | | | |
|---|---|---|---|---|
| 0% | ≦ | C | ≦ | 0.03% |
| 0% | ≦ | Mn | ≦ | 2% |
| 0% | ≦ | Si | ≦ | 0.5% |
| 8% | ≦ | Ni | ≦ | 9% |
| 17% | ≦ | Cr | ≦ | 18% |
| 0% | ≦ | Mo | ≦ | 0.4% |
| 3% | ≦ | Cu | ≦ | 3.5% |
| 0% | ≦ | N | ≦ | 0.03% |
| | | S | ≦ | 0.01% |
| | | P | ≦ | 0.04% |

the remainder being iron and impurities resulting from the production.

This wire can be employed especially for manufacturing a spring or for producing a cable or may constitute the core of a wire for elastomer reinforcement.

The invention also relates to a process for the manufacture of the wire according to the invention. The process consists in obtaining a supply of a machine wire of diameter greater than or equal to 5 mm, consisting of an austenitic steel whose chemical composition is consistent with what is indicated above, in subjecting it to a hyperquenching treatment in order to give it an entirely austenitic structure, in pickling it and in forming it by cold plastic deformation, generally without intermediate heat treatment, or, in the case of the smallest diameters, with an intermediate hyperquenching followed by a reduction in section greater than 300. The aim of the forming by cold plastic deformation is especially to reduce the section and, optionally, to give the wire section the desired shape (round, square, triangle, and the like). This plastic deformation can be performed by wiredrawing, by rolling or by any other process for manufacturing a wire by cold plastic deformation. The process may be supplemented by an aging heat treatment performed on the strongly cold-worked wire, and consisting of a hold at a temperature of between 400 and 475° C. for a period of between 5 min and 3 hours.

Finally, the invention relates to an austenitic stainless steel whose chemical composition includes, by weight:

| | | | | |
|---|---|---|---|---|
| 0% | ≦ | C | ≦ | 0.03% |
| 0% | ≦ | Mn | ≦ | 2% |
| 0% | ≦ | Si | ≦ | 0.5% |
| 8% | ≦ | Ni | ≦ | 9% |
| 17% | ≦ | Cr | ≦ | 18% |
| 0% | ≦ | Mo | ≦ | 0.4% |
| 3% | ≦ | Cu | ≦ | 3.5% |
| 0% | ≦ | N | ≦ | 0.03% |
| | | S | ≦ | 0.01% |
| | | P | ≦ | 0.04% |

the remainder being iron and impurities resulting from the production.

DESCRIPTION OF THE PREFERRED EMBODIMENTS

The invention will now be described more precisely, but without any limitation being implied, and illustrated by the examples which follow.

To manufacture a fine drawn wire of diameter smaller than or equal to 2 mm, a machine wire is employed of diameter greater than or equal to 5 mm made of austenitic stainless steel whose chemical composition includes, by weight:

less than 0.03% of carbon because, above this, the martensite present in a high proportion in the drawn wire becomes sensitive to delayed rupture and the springs can then crack under the effect of residual forming stresses; in general the carbon content is higher than 0.005% because it is extremely difficult to descend below during the refining operations;

from 0% to 2%, and preferably more than 2%, of manganese, to bind the sulfur and prevent the formation of chromium sulfides of low melting point; above 2% the steel becomes very difficult to decarbonize without reoxidizing the manganese, and this very appreciably increases the costs of manufacture;

from 0% to 0.5% of silicon, the presence of which (in general more than 0.1%) results from the production of the steel and greatly hardens the martensite present in the cold-worked wires; in order to avoid an excessive hardening before the forming operation, its content is limited to 0.5%;

from 8% to 9% of nickel, to guarantee an austenitic structure during the hot rolling and after the hyperquenching treatment;

from 17% to 18% of chromium to obtain a sufficient corrosion resistance without giving rise to too many difficulties in pickling after the hot rolling;

from 0% to 0.4% of molybdenum to improve the corrosion behavior without damaging the other properties;

from 3% to 3.5% of copper to permit the hardening by precipitation during the aging treatment after wiredrawing; the content is limited to 3.5% because, above this, copper gives rise to difficulties in hot rolling;

from 0% to 0.03% of nitrogen which results from the production; its content is generally higher than 0.005%, but must remain lower than 0.03% to avoid risks of delayed cracking;

less than 0.01% of sulfur, which is an impurity whose content must be limited because, in too large a quantity, it makes the drawn wires brittle;

less than 0.04% of phosphorus, which is an impurity which can create defects during hot rolling;

the remainder being iron and impurities resulting from the production.

All of the elements have an effect on the stability of the austenitic structure during the hot rolling and after hyperquenching, but also on the solidification structure. The regions of composition for each of the elements have been chosen such as to make this solidification structure ferritic and free from high segregations.

As the inventors have unexpectedly observed, this steel has the advantage of making it possible to reach high mechanical characteristics by wiredrawing and structural hardening without requiring any intermediate annealing, even in the case of diameter reductions of more than 20-fold.

With the steel which has just been defined a machine wire of diameter greater than or equal to 5 mm is manufactured by hot rolling and is subjected to a hyperquenching treatment consisting in heating to a temperature between 800° C. and 1250° C., followed by air, or more rapid, cooling, in order to give it an entirely austenitic structure, and it is then pickled.

The hyperquenched and pickled machine wire thus obtained is then drawn to a diameter smaller than 2 mm in one or more stages, each of several passes, without it being necessary to perform an intermediate heat treatment, at least as long as the ratio of the initial section to the final section remains smaller than 485. To manufacture the smallest diameters, especially the diameters smaller than 0.25 mm, it may be necessary to perform an intermediate hyperquenching intended to restore the deformability of the metal. However, in this case, in order to obtain the desired mechanical characteristics, the final cold working, that is to say that performed after the intermediate hyperquenching, must correspond to a reduction in section greater than 300 (final section/initial section≦1/300).

To obtain the final desired mechanical properties, that is to say a tensile strength, as a function of the diameter, in accordance with the standard and repeated in the table below, an aging heat treatment is performed.

Minimum Tensile Strength Imposed by the Standards

| ϕ mm | 1.5/1.75 | 1.25/1.5 | 1/1.25 | 0.8/1 | 0.65/0.8 | 0.5/0.65 | 0.4/0.5 | 0.3/0.4 | 0.2/0.3 | ≦0.2 |
|---|---|---|---|---|---|---|---|---|---|---|
| R MPa | 1950 | 2000 | 2050 | 2100 | 2125 | 2150 | 2200 | 2225 | 2250 | 2275 |

This aging treatment consists in heating for a period of between 5 min and 3 hours to a temperature of between 400 and 475° C. It gives rise to a hardening resulting from the precipitation of ϵCu (c.f.c.) in a centered cubic structure α' martensite induced by the wiredrawing deformation). With everything else being otherwise equal, this hardening is proportionally greater the higher the α' martensite content.

According to the envisaged application, the aging treatment may be performed either directly after wiredrawing or after additional operations have been performed on the wire, for example after it has been formed to manufacture a spiral spring.

By way of example, drawn wires 1 mm, 0.5 mm and 0.25 mm in diameter in accordance with the invention were manufactured by starting with a machine wire 5.5 mm in diameter, consisting of an austenitic stainless steel whose chemical composition was the following (in % by weight):

| C | Mn | Si | Ni | Cr | Mo | Cu | N | S | P |
|---|---|---|---|---|---|---|---|---|---|
| 0.011 | 1.83 | 0.4 | 0.08 | 17.24 | 0.36 | 3.24 | 0.027 | 0.004 | 0.025 |

The machine wire was hyperquenched by reheating to 1080° C. and cooling with water and then pickled.

The machine wire was then drawn according to the following schemes:

wire 1 mm in diameter: in one drop from 5.5 mm to 1 mm, in 12 passes;

wire 0.5 mm in diameter: from the cold-worked 1 mm wire, in one drop of 8 passes from 1 mm to 0.5 mm;

wire 0.25 mm in diameter: from the cold-worked 1 mm wire in one drop of 5 passes from 1 mm to 0.7 mm followed by a drop of 8 passes from 0.7 mm to 0.25 mm, without intermediate heat treatment.

After drawing, the wire was aged by holding at 435° C. for 1 hour.

The mechanical characteristics (tensile strength Rm and strength at a plastic deformation of 0.2%, $Rp_{0.2}$) obtained before and after aging, as well as the α' martensite content, were:

| | Before aging | | | After aging | |
|---|---|---|---|---|---|
| Diameter | % α' | Rp0.2 (MPa) | Rm (MPa) | Rp0.2 (MPa) | Rm (MPa) |
| 1 mm | 52 | 1702 | 1856 | 2070 | 2197 |
| 0.5 mm | 65 | 2083 | 2291 | 2668 | 2723 |
| 0.25 mm | 75 | 2580 | 2666 | 3076 | 3095 |

The wires thus obtained were employed for manufacturing springs as indicated above, which have the advantage of exhibiting characteristics that are at least equal to those of the springs manufactured in 1.4310 standard grade, with an equal, or even improved, relaxation, while being simpler and less costly to manufacture.

Because of their characteristics, the wires according to the invention can also be employed for manufacturing wires for the reinforcement of elastomers, for example for producing tire reinforcements. These reinforcing wires comprise a core consisting of a drawn wire according to the invention, coated, for example, by nickel- and brass-plating (this coating is intended to ensure good bonding with rubber).

What is claimed is:

1. A stainless steel wire of diameter smaller than 2 mm and with a tensile strength higher than 2100 MPa, which consists of a steel whose chemical composition comprises, by weight:

| | | | | |
|---|---|---|---|---|
| 0% | ≦ | C | ≦ | 0.03% |
| 0% | ≦ | Mn | ≦ | 2% |
| 0% | ≦ | Si | ≦ | 0.5% |
| 8% | ≦ | Ni | ≦ | 9% |
| 17% | ≦ | Cr | ≦ | 18% |
| 0% | ≦ | Mo | ≦ | 0.4% |
| 3% | ≦ | Cu | ≦ | 3.5% |
| 0% | ≦ | N | ≦ | 0.03% |
| | | S | ≦ | 0.01% |
| | | P | ≦ | 0.04% |

the remainder being iron and impurities resulting from the production.

2. The wire as claimed in claim 1, wherein its diameter is smaller than or equal to 0.5 mm and its tensile strength higher than or equal to 2200 MPa.

3. The wire as claimed in claim 1, wherein its diameter is smaller than or equal to 0.3 mm and its tensile strength higher than or equal to 2250 MPa.

4. Wire according to claim 1, characterized in that its diameter is smaller than or equal to 0.2 mm and its tensile strength higher than or equal to 2275 MPa.

5. A spring which consists of a wire as claimed in claim 1.

6. A wire for elastomer reinforcement comprising at least one core made of stainless steel, characterized in that the core consists of a wire as claimed in claim 1.

7. A process for the manufacture of a wire according to claim 1, characterized in that:

a supply is obtained of a machine wire of diameter greater than or equal to 5 mm made of a steel whose chemical composition comprises, by weight:

| | | | | |
|---|---|---|---|---|
| 0% | ≦ | C | ≦ | 0.03% |
| 0% | ≦ | Mn | ≦ | 2% |
| 0% | ≦ | Si | ≦ | 0.5% |
| 8% | ≦ | Ni | ≦ | 9% |
| 17% | ≦ | Cr | ≦ | 18% |
| 0% | ≦ | Mo | ≦ | 0.4% |
| 3% | ≦ | Cu | ≦ | 3.5% |
| 0% | ≦ | N | ≦ | 0.03% |
| | | S | ≦ | 0.01% |
| | | P | ≦ | 0.04% |

the remainder being iron and impurities resulting from the production, a hyperquenching is performed on the machine wire in order to obtain an entirely austenitic structure, and a forming by cold plastic deformation is performed to obtain a diameter smaller than 2 mm.

8. The process according to claim 7, characterized in that the forming by cold plastic deformation is performed without intermediate heat treatment.

9. The process according to claim 7, characterized in that the forming by cold plastic deformation is performed with an intermediate hyperquenching and the reduction in section performed after the intermediate hyperquenching is greater than 300.

10. Process according to claim 8, characterized in that, in addition, an aging heat treatment is performed, consisting of a hold at a temperature of between 400° C. and 475° C. for a period of between 5 min and 3 hours.

the remainder being iron and impurities resulting from the production.

11. Wire according to claim 1, characterized in that its section is round.

12. Process according to claim 7, characterized in that the forming by cold plastic deformation is a wiredrawing in several passes.

* * * * *